US007132643B2

(12) United States Patent
Kato

(10) Patent No.: US 7,132,643 B2
(45) Date of Patent: Nov. 7, 2006

(54) OPTICAL TRANSDUCER HAVING OPTICAL MODULATOR IN THE VICINITY OF ROTATIONAL AXIS OF MOVING OBJECT AND MUSICAL INSTRUMENT USING THE SAME

(75) Inventor: Tadaharu Kato, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 157 days.

(21) Appl. No.: 10/949,416

(22) Filed: Sep. 27, 2004

(65) Prior Publication Data

US 2005/0067560 A1 Mar. 31, 2005

(30) Foreign Application Priority Data

Sep. 25, 2003 (JP) ..... 2003-333415

(51) Int. Cl.
*G06M 7/00* (2006.01)
*G10H 3/06* (2006.01)

(52) U.S. Cl. ..... 250/221; 250/227.22; 250/229; 84/639; 84/724

(58) Field of Classification Search ..... 250/221, 250/227.22, 229; 84/21, 639, 723, 724; 385/88, 385/89

See application file for complete search history.

(56) References Cited

U.S. PATENT DOCUMENTS 5,001,339 A 3/1991 Starkey et al.
5,042,353 A 8/1991 Stahnke
5,237,123 A 8/1993 Miller
6,384,305 B1 * 5/2002 Lee ..... 84/21
6,403,872 B1 6/2002 Muramatsu et al.
6,515,213 B1 2/2003 Muramatsu et al.
2001/0003945 A1 6/2001 Muramatsu et al.
2003/0025071 A1 2/2003 Kato et al.
2003/0070526 A1 4/2003 Muramatsu et al.
2005/0077453 A1 * 4/2005 Kato ..... 250/221

FOREIGN PATENT DOCUMENTS

JP 2002-156967 A 5/2002
JP 2002-175070 A 6/2002

* cited by examiner

*Primary Examiner*—Kevin Pyo
(74) *Attorney, Agent, or Firm*—Smith Patent Office

(57) ABSTRACT

An optical transducer includes a photo-electric converter supported by a shank flange rail and optical modulators respectively attached to hammers of an automatic player piano; since a neck portion makes a photo-modulating pattern closer to the rotational axis of each hammer than a boss portion adhered to the side surface of the hammer shank, the photo-modulating pattern is rotated in a narrow space in the vicinity of the rotational axis so as to permit the photo-electric converter to monitor the hammer motion between the rest position and the end position without any interference with other component parts, and the boss portion is easily adhered to the side surface under the condition that a worker lifts the hammer over the adjacent hammers.

21 Claims, 8 Drawing Sheets

OPTICAL TRANSDUCER HAVING OPTICAL MODULATOR IN THE VICINITY OF ROTATIONAL AXIS OF MOVING OBJECT AND MUSICAL INSTRUMENT USING THE SAME

FIELD OF THE INVENTION

This invention relates to an optical transducer and, more particularly, to an optical transducer having a photo-coupler and an optical modulator moved relatively to the photo-coupler and a musical instrument equipped with the optical transducer.

DESCRIPTION OF THE RELATED ART

Hybrid musical instruments have been sold in the musical market. The hybrid musical instrument is fabricated on the basis of acoustic musical instruments, and electronic tone generating systems or electric tone generating systems are incorporated in the hybrid musical instruments. An automatic player piano is a typical example of the hybrid musical instrument. The automatic player piano is fabricated on the basis of an acoustic piano, and an electronic tone generating system is installed in the acoustic piano for play-back.

The electronic tone generating system includes an array of solenoid-operated key actuators, a controller and optical transducers. The array of solenoid-operated key actuators is provided in the space between the key bed and the keyboard, and the solenoid-operated key actuators, which are respectively associated with the black/white keys, are selectively energized with a driving pulse signal. When a user wishes to enjoy a piece of music through the automatic player piano, he or she instructs the controller to reproduce the tones along the music passage. Then, the controller accesses a data memory, and sequentially fetches music data codes. The controller determines the tones to be produced and a time at which each solenoid-operated key actuator gives rise to the key motion. When the time comes, the controller supplies the driving pulse signal to the solenoid-operated key actuator. Then, the associated key is driven with the plunger, which forms a part of the solenoid-operated key actuator, for the key motion, and the string is struck with the hammer so as to produce the tone through the vibrations thereof.

The set of music data codes may be loaded from a floppy disk into the controller. Another user may wish to prepare the set of music data codes through his or her fingering on the keyboard. One of the optical transducers is provided in the space between the key bed and the keyboard, and reports the key motion to the controller. Another optical transducer is provided in the space between the hammers and the strings, and reports the hammer motion to the controller. The key motion and hammer motion are analyzed in the controller for pieces of music data representative of the tones produced through the vibrations of the strings, and the pieces of music data are memorized in the music data codes. Thus, the optical transducers are the integral parts of the electronic tone generating system.

A typical example of the optical transducer is disclosed in Japanese Patent Application laid-open No. 2002-175070. The prior art optical transducer disclosed in the Japanese Patent Application laid-open is hereinafter referred to as "first prior art optical transducer". The first prior art optical transducer includes a photo-coupler, i.e., a light radiating element and a light detecting element and a shutter plate, and serves as a hammer sensor. The photo-coupler is mounted on the leading end portion of the hammer sensor tilting mechanism, which is turn is secured at the opposite end portion to the hammer shank rail. On the other hand, the shutter plate is "attached to the upper surface of the hammer shank". This means that the shutter plate upwardly projects from the upper surface of the hammer shank. The shutter plate is seemed to be perpendicular to the centerline of the hammer shank in FIG. 2 of the Japanese Patent Application laid-open. The area assigned to the shutter plate is spaced from the rotational axis of the hammer shank. A window is formed in the shutter plate. While a worker is turning the tilting nut, the leading end portion is bent, and, accordingly, the photo-coupler is tilted over the shutter plate. Thus, the photo-coupler is moved relatively to the shutter plate by means of the hammer sensor tilting mechanism, and the relative position between the photo-coupler and the shutter plate is optimized.

The photo-coupler radiates a light beam across the trajectory of the shutter plate. While the hammer is being driven for rotation about the hammer shank flange, the shutter plate is also rotated, and gets closer and closer to the light beam. The light beam is intersected with the shutter plate, thereafter, the window permits the light to pass therethrough, and the light is intersected with the shutter plate, again. Thus, the light is twice intersected with the shutter plate, accordingly, is modulated in a narrow range immediately before striking the string.

Another prior art optical transducer is disclosed in Japanese Patent Application Laid-open No. 2002-156967, which is corresponding to Japanese Patent Application No. 2000-351192. U.S. Ser. No. 10/002,262 was filed on the basis of the Japanese Patent Application, and U.S. Pat. No. 6,515,213B2 has been already assigned to the U.S. patent application. The prior art optical transducer disclosed therein is hereinafter referred to as "second prior art optical transducer". The second prior art optical transducer includes a photo-filter plate, a photo radiating port, a photo receiving port, optical fibers and a combined photo device of photo emitting/photo detecting elements. The combined photo device is connected to the photo radiating port and photo receiving port through the optical fibers, and the photo radiating port and photo receiving port are provided on both sides of the hammer assembly. The hammer assembly includes a hammer shank flange fixed to a shank flange rail, a hammer shank rotatably connected to the hammer shank flange by means of a pin and a hammer head fixed to the leading end of the hammer shank. The photo-filter plate has a sectorial portion where a photo-shield pattern is printed on the photo-filter plate. The photo-shield pattern is implemented by plural non-transparent arcs. The photo-filter plate is adhered to the side surface of the hammer shank in such a manner that the rotational axis of the hammer shank is aligned with the center of the sectorial portion, and the photo radiating port and photo receiving port are provided on both sides of the photo-shield pattern. As a result, the light beam passes through the photo-filter plate between the photo radiating port and the photo receiving port. While the hammer is being driven for rotation, the photo-filter plate and, accordingly, photo-shield pattern are also rotated about the rotational axis of the hammer shank. Thus, the light incident on the photo receiving port is modulated by means of the photo-filter plate depending upon the angle over which the hammer is rotated.

Although the first prior art optical transducer is advantageous in that a worker easily attaches the shutter plate to the upper surface of the hammer shank, the light is merely modulated in the narrow range immediately before the strike at the string. If the shutter plate is longer than that of the first prior art optical transducer is, the range is widened. However, the long shutter plate widely projects over the photo-coupler at the strike with the hammer. In order to permit the long shutter plate to project, wide vacant space is required for the long shutter plate. In the acoustic piano, the strings are stretched closely to the hammers, and the space between the hammer shanks and the strings is too narrow to permit the long shutter plate to project over the photo-coupler.

On the other hand, the second prior art optical transducer is advantageous in that the light is modulated with the photo-filter plate from the rest position of the hammer to the strike at the string by virtue of the location of the photo-filter. However, a problem is encountered in the second optical transducer in the assembling work. It is not hard to adhere the photo-filters to the individual hammer shanks before the assemblage to the hammer shank flanges in the manufacturing factory. A user sometimes requests the manufacturer to retrofit an acoustic piano to the automatic player piano. Then, the manufacturer sends workers to the user's home, and the workers install the tone generating system in the acoustic piano at the user's home. The workers attach the array of solenoid-operated key actuators to the key bed under the rear portions of the black/white keys, and connect the controller to the solenoid-operated key actuators. The workers further adhere the photo-filter plates to the hammer shanks, respectively, and secure the array of photo radiating ports and photo receiving ports to the shank flange rail. Nevertheless, it is impossible to adhere the photo-filter plates to the hammer shanks without disassembling the hammers from the shank flange rail, because the hammers are tightly arrayed. The worker may rotate one of the hammers from the rest position. Then, the side surfaces of the hammer shank are exposed. Although the leading end portion of the hammer shank is widely spaced from the remaining hammer shanks, the rotational axis of the hammer is aligned with the rotational axes of the adjacent hammers, and the other end portion of the hammer shank is still partially overlapped with the adjacent hammer shanks. The workers feel it difficult to adhere the photo filters to the other end portions of the hammer shanks. For this reason, the workers disassemble the hammers from the shank flange rail, and assemble them to the shank flange rail after adhering the photo-filters to the other end portions of the hammer shanks. Thus, the retrofitting work is complicated and time-consuming.

As will be understood, there is a trade-off between the easiness of the retrofitting work and the detectable range. The applicant searched the database for other optical transducers. However, the applicant can not find any prior art optical transducer, which satisfies the above-described requirements. Followings are the related arts to which the applicant paid attention.

Yet another prior art optical transducer is disclosed in U.S. Pat. No. 6,403,872 to Muramatsu et al. Although various sorts of transducers are disclosed in the U.S. patent, only the prior art transducers shown in FIGS. 4, 10, 12 and 13 of the U.S. patent are categorized in the optical transducer. The prior art optical transducers shown in FIGS. 4, 10 and 12 of the U.S. patent are of the type converting the reflection on the hammer shanks to the photo current, and neither shutter plate nor photo-filter are not incorporated therein. The prior art optical transducer shown in FIG. 13 of the U.S. patent includes the photo-reflection pulse sensor and the photo scale. The photo scale is attached to the upper surface of the hammer shank, and is formed with photo-reflecting stripes and photo-absorbing stripes alternated with the photo-reflecting stripes. The photo-reflection pulse sensor counts the number of reflection on the photo-reflecting stripes, and the controller determines the angle over which the hammer is rotated. The light is not modulated with the photo scale, and the photo scale is attached to the upper surface of the hammer shank. Any photo-filter or optical modulator is not required for all the transducers disclosed in the U.S. patent. In other words, the prior art transducers disclosed in the U.S. patent are different in principle from the first and second prior art optical transducers.

Still another prior art transducer is disclosed in U.S. patent to Stahnke. A small plate projects from the hammer shank, and a device is illustrated over the small plate. The small plate and device may form a transducer. However, Stahnke does not give any clear description on the small plate and associated device. Even if the small plate and device form an optical transducer, the optical transducer is categorized in the first prior art optical transducer.

Yet another prior art optical transducer is disclosed in U.S. Pat. No. 5,237,123 to Miller. The prior art optical transducer includes sensor assemblies and a fin transducer 25. The sensor assemblies are supported by the sensor rail, and are stable. On the other hand, the fin transducer is attached to the leading end portion of the hammer shank, and projects from the hammer shank. The fin transducer is curved from the hammer shank toward the sensor assemblies, and is seemed to have the radius of curvature equal to that of the leading end portion to which the fin transducer is attached. Although the detectable range is widened, the prior art optical transducer is categorized in the first optical transducer.

Still another prior art optical transducer is disclosed in U.S. Pat. No. 5,001,339 to Starkey et al. The prior art optical transducer includes an actuator or flag and a sensor package. The light beam, which is created in the sensor package, is gradually intersected with the flag, and the amount of light is converted to the photo current in the sensor package. The prior art optical transducer is placed under a key (see FIG. 7A of the U.S. patent), and the leading end portion of the flag is held in contact with the lower surface of the key by means of the coil spring. While a pianist is depressing the key, the depressed key gives rise to the rotation of the flag, and the light beam is gradually intersected with the flag. The flag is not secured to the key, and no assembling work is required for the key and flag. The prior art optical transducer disclosed in the U.S. patent is different from the first and second prior art optical transducer.

SUMMARY OF THE INVENTION

It is therefore an important object of the present invention to provide an optical transducer, which is compact, easy in assembling work and wide in detectable range.

It is also an important object of the present invention to provide a musical instrument, in which the optical transducer is installed.

The present inventor contemplated the tradeoff between the easiness of the retrofitting work and the detectable range. The present inventor did not think it inevitable to secure the optical modulator to the hammer shank concentrically to the rotational axis of the hammer. Even if the light was modulated with an optical modulator in the proximity to the rotation axis, it was possible to connect the optical modulator to a certain portion of the hammer shank widely spaced from the rotational axis.

To accomplish the object, the present invention proposes to give a modulating portion and a connecting portion different values of the radius of curvature from an instantaneous center of the trajectory of a moving object.

In accordance with one aspect of the present invention, there is provided an optical transducer producing electric signals representative of current status of moving objects having respective surfaces overlapped with one another at rest positions and moved on respective trajectories each having an instantaneous center, and the optical modulator comprises a photo-electric converter radiating light and converting incident light to the electric signals and optical modulators including respective connecting portions secured to the surfaces of the moving objects, respectively, and photo-modulating portions closer to the instantaneous centers than the connecting portions and modulating the light for supplying the incident light representative of the current status to the photo-electric converter.

In accordance with another aspect of the present invention, there is provided a musical instrument for producing tones comprising plural series of component parts independently actuated for specifying tones to be produced and a tone generating system associated with the plural series of component parts, producing the tones specified through the plural series of component parts and including a data processing module analyzing music data for producing the tones and an optical transducer connected to the data processing module and monitoring predetermined component parts of the plural series having respective surfaces overlapped with one another at rest positions and moved on respective trajectories each having an instantaneous center for producing electric signals representative of predetermined pieces of the music data, and the optical transducer includes a photo-electric converter radiating light and converting incident light to the electric signals and optical modulators including respective connecting portions secured to the surfaces of the predetermined component parts, respectively, and photo-modulating portions closer to the instantaneous centers than the connecting portions and modulating the light for supplying the incident light representative of the current status to the photo-electric converter.

BRIEF DESCRIPTION OF THE DRAWINGS

The features and advantages of the optical transducer and musical instrument will be more clearly understood from the following description taken in conjunction with the accompanying drawings, in which.

DESCRIPTION OF THE PREFERRED EMBODIMENTS

Figure 1:
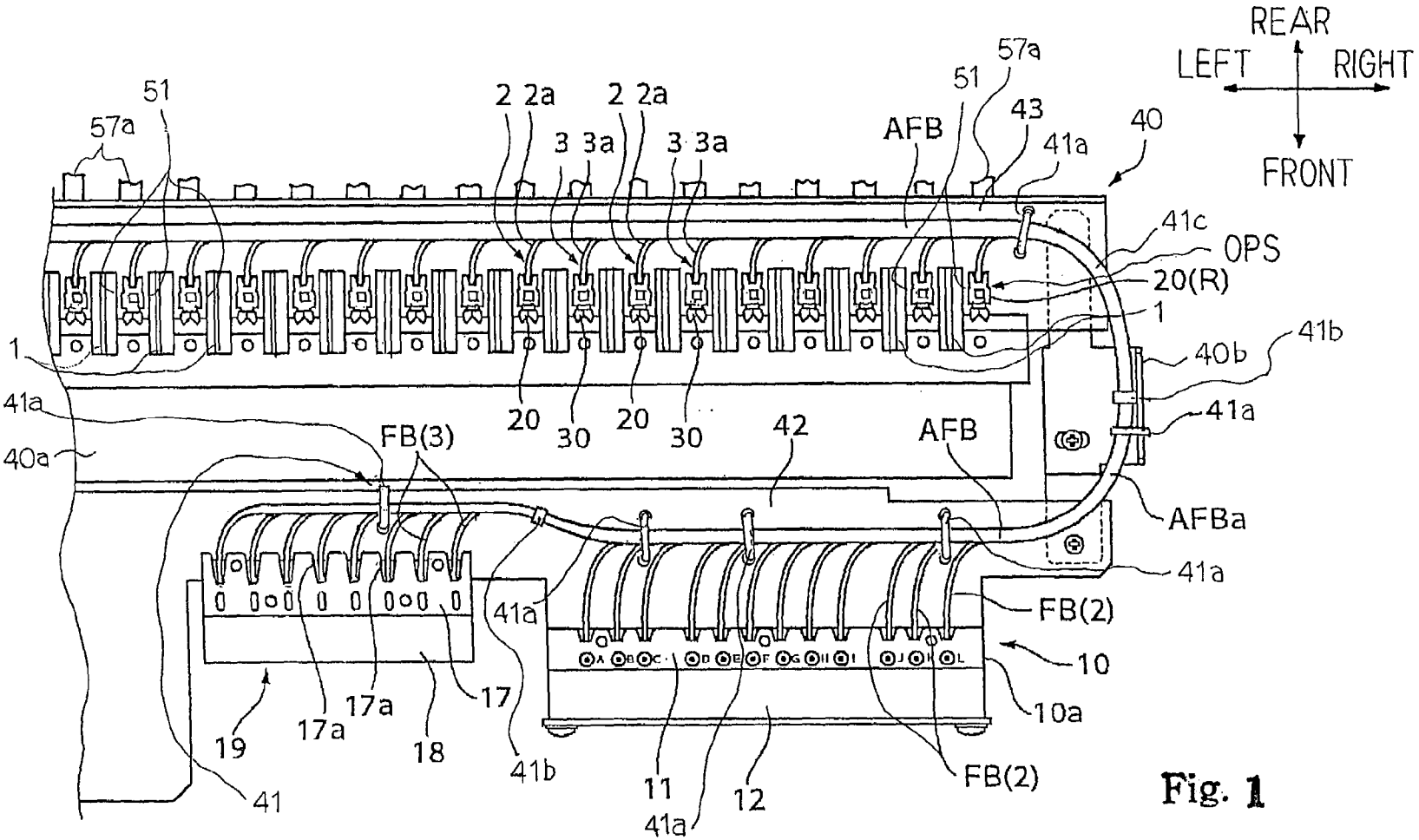
FIG. 1 is a plane view showing an optical transducer according to the present invention.

An optical modulator embodying the present invention monitors moving objects for producing electric signals representative of current status of the moving objects on the entire trajectories, and largely comprises a photo-electric converter and optical modulators. While the moving objects are staying at respective rest positions, the moving objects have respective surfaces overlapped with one another. The moving objects are independently moved along the respective trajectories, which have respective instantaneous centers. In case where the instantaneous centers are unchanged, the moving objects are rotated about the unchanged instantaneous centers.

Each of the optical modulators is associated with one of the moving objects, and has a connecting portion and a photo-modulating portion. The connecting portion is secured to the surface of the associated moving object so that the photo-modulating portion is moved together with the moving object. The photo-electric converter radiates light toward the photo-modulating portion, and the light is modulated to incident light through the photo-modulating portion depending upon the current status of the moving object on the trajectory. After the photo-modulation, the incident light is supplied from the photo-modulating portion to the photo-electric converter. The incident light is converted to the electric signal by means of the photo-electric converter. Since the current status has the influence on the light, a piece of data representative of the current status is carried on the incident light, and is transferred from the incident light to the electric signal through the photo-electric conversion. The other electric signals are similarly produced in cooperation of the other optical modulators and photo-electric converter. Thus, the optical transducer produces the electric signals representative of the current status of the moving objects.

The photo-modulating portions are closer to the instantaneous centers than the connecting portions. This feature results in the following advantages.

First, while the moving objects are independently traveling along the trajectories, the space required for each photo-modulating portion is narrower than the space required for the connecting portion. Even through the photo-modulating portion is small, the optical transducer can continuously produce the electric signals along the trajectories of the moving objects by means of the small photo-modulating portions, and the small photo-modulating portions are not interfered with component parts.

Second, while a worker is assembling the optical modulators with the moving objects, the worker easily quickly connects the connecting portions to the surfaces of the moving objects. Although the surfaces are overlapped with one another at the rest positions, the worker can expose the surfaces to the vacant space by selectively moving the moving objects from the rest positions, because the area to which the connecting portion is to be secured is widely moved rather than the area equal in radius of curvature to the photo-modulating portion.

As will be appreciated, the optical modulator embodying the present invention is free from the trade-off, and is advantageous over the prior art shutter plate and prior art photo-filter.

The optical modulator is available for a musical instrument. The musical instrument includes plural series of component parts and a tone generating system. The plural series of component parts are used for specifying tones to be produced, and are connected to the tone generating system.

The tone generating system is responsive to the action of the plural series of component parts so as to produce the tones.

The tone generating system includes the optical transducer and a data processing module. The optical transducer monitors predetermined component parts of the series as the moving objects, and supplies the electric signals representative of the current status to the data processing module. Predetermined pieces of music data are carried on the electric signals, and are representative of the current status of the predetermined component parts. The data processing module analyzes music data, which contains the predetermined pieces of music data. Upon completion of the analysis, the data processing module may produce a set of music data representative of the tones to be produced. The set of music data may be stored in a suitable information storage medium or transferred to another electronic musical instrument. Otherwise, the data processing module may supply the music data in a real time fashion to an audio system so as to produce the tones specified through the plural series of component parts. The optical transducer installed in the musical instrument is similar in constitution to the above-described optical transducer, and achieves all the advantages described hereinbefore.

First Embodiment

Figure 2:
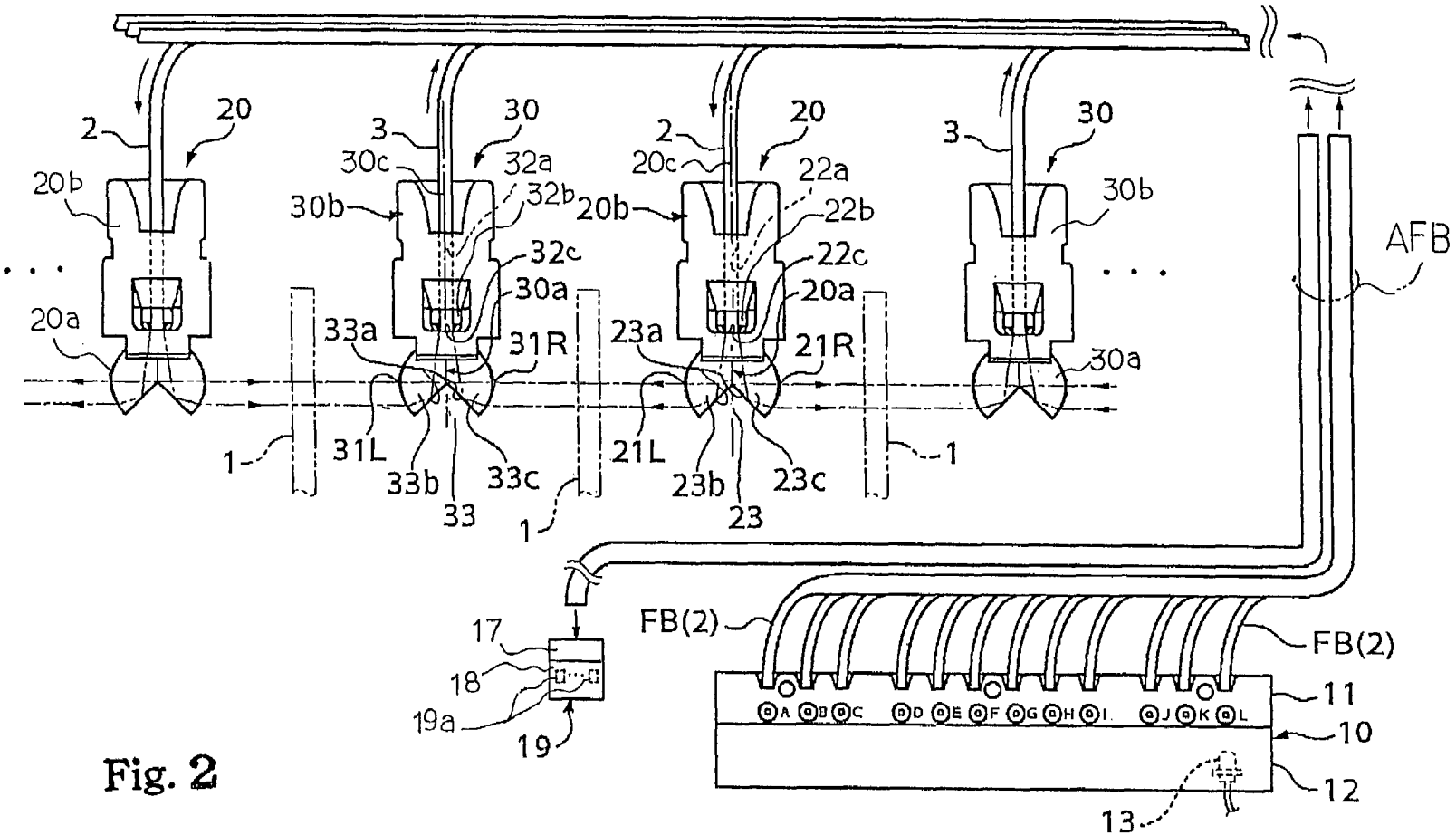
FIG. 2 is a plane view showing sensor heads incorporated in the optical transducer.

Referring to FIGS. 1 and 2 of the drawings, an optical transducer embodying the present invention largely comprises optical modulators 1 and a photo-electric converter OPS. The optical modulators 1 are respectively attached to moving objects such as, for example, hammer shanks 57*a*, which form parts of hammers 50 of an automatic player piano shown in FIG. 3, and are moved together with the hammers. The photo-electric converter OPS radiates light beams across the optical modulators 1, respectively, and the light is modulated with the optical modulators 1 depending upon the current status of the hammers 50. In this instance, the current status means the positions of the hammers 50 on the trajectories.

In the following description, terms "front", "rear", "right" and "left" are indicative of the relative positions, and arrows stand for the relative positions in FIG. 1. A line drawn between a front position and a corresponding rear position extends in the "fore-and-aft direction", and the fore-and-aft direction crosses a "lateral direction". For example, the hammers 50 are arrayed in the lateral direction.

The photo-electric converter OPS includes optical fibers 2/3, a light emitting unit 10, a light detecting unit 19, light radiating sensor heads 20 and light receiving sensor heads 30. The light radiating sensor heads 20, light receiving sensor heads 30 and optical fibers 2/3 are arranged on the upper surface of a base frame 40. In this instance, the light emitting unit 10 and light detecting unit 19 are located in front of the light radiating sensor heads/light receiving sensor heads 20/30. The light radiating sensor heads 20 and light receiving sensor heads 30 are secured to the base frame 40, and are remote from the light emitting unit 10 and light detecting unit 19. The light emitting unit 10 and light detecting unit 19 are fixed to the base frame 40, and are connected to the light radiating sensor heads 20 and light receiving sensor heads 30 through the optical fibers 2 and optical fibers 3, respectively. The optical fibers 2/3 extend on a predetermined route on the reverse surface, and are fastened to the base frame 40 by means of a fastener 41. A cover plate 54 (see FIG. 3) is secured to the base frame 40 so that the light radiating sensor heads 20 and light receiving sensor heads 30 are confined in the space between the base frame 40 and the cover plate 54. The cover plate 54 prevents the light radiating sensor heads 20 and light receiving sensor heads 30 from the environmental light.

Description is made on the arrangement of the component parts 2/3, 10/19, 20/30, 40 and 41 in more detail. The light radiating sensor heads 20 and light receiving sensor heads 30 are alternately arranged in the lateral direction at intervals, and are remote from the light emitting unit 10 and light detecting unit 19. The light emitting unit 10 is slightly offset from the light detecting unit 19 in the fore-and-aft direction, and is laterally spaced from the light detecting unit 19.

In this instance, the base frame 40 is laterally elongated, and is separated into three sections, which are a central section 40*a*, a front section 42 and a rear section 43. The front section 42 and rear section 43 are respectively assigned to the light radiating sensor heads/light receiving sensor heads 20/30 and the light emitting unit/light detecting unit 10/19. Although a data processing module is further assigned to the front section 42, the data processor module is located on the left side of the light detecting unit 19, and is not shown in FIG. 1. The light radiating sensor heads 20 and light receiving sensor heads 30 are disposed onto the reverse surface of the rear section 43 at intervals, and slots 51 are formed in the rear section 43 at intervals. Each of the slots 51 is located in an area between the light radiating sensor head 20 and the adjacent light receiving sensor head 30, and is assigned to one of the optical modulators 1. The light emitting unit 10 and light detecting unit 19 are alternately arrayed between the rightmost light radiating sensor head 20(R) and the leftmost light radiating sensor head (not shown).

The central section 40*a* is contiguous to the rear section 43, and is retracted from the right sides of the front/rear sections 42/43. The gap between the front section 42 and the rear section 43 is bridged with a connecting plate 40*b* on the right side of the central section 40*a*, and the connecting plate 40*b* is fixed at the front end portion to the front section 42 and at the rear end portion to the rear section 43. Thus, the front section 42 is connected to the rear section 43 by means of the connecting plate 40*b* on the right side of the rightmost light radiating sensor head 20(R).

The optical fibers 2/3 laterally extend on the rear section 43 at the back of the light radiating sensor heads/light receiving sensor heads 20/30, and turn around in the right portion of the rear section 43. The optical fibers 2/3 pass over the connecting plate 40*b*. The optical fibers 2/3 turn around in the right portion of the front section 42, again, and laterally extend on the front section 42 at the back of the light emitting device/light detecting device 10/19. Thus, the optical fibers 2/3 are twice warped at the back of and in front of the connecting plate 40*b*. The optical fibers 2/3 are fastened to the rear section/connecting plate/front section 43/40*b*/42 by means of synthetic resin strips 41*a*, which form in combination the fastener 41, and the synthetic resin strips 41*a* make the optical fibers 2/3 immovable on the route.

The optical fibers 2/3 are made of transparent synthetic resin such as, for example, acrylic resin, and are of the order of 0.5 millimeter in diameter. In the following description, term "minor bundle" means a bundle of several optical fibers 2 or 3, and term "major" bundle is indicative of a bundle of the minor bundles. Five optical fibers 2 or 3 are, by way of example, bundled in a minor bundle FB(2) or FB(3). The major bundle of optical fibers 2/3 is labeled with "AFB". The major bundle AFB has a warped portion AFBa between the rightmost synthetic resin strip 41*a* on the rear section 43 and the rightmost synthetic resin strip 41*a* on the front section 42. The warped portion AFBa sideward projects on the right side of the light side surface 10*a* of the light emitting unit 10. The minor bundles of optical fibers 2 are labeled with "FB(2)", and the minor bundles of optical fibers 3 are labeled with "FB(3)". The minor bundles FB(2)/FB(3) are separated from the major bundle AFB on the front section 42 near the light emitting unit/light detecting unit 10/19, and the optical fibers 2/3 are separated from the minor bundles FB(2)/FB(3) on the rear section 43 in the vicinity of the associated light radiating sensor heads/light receiving sensor heads 20/30.

The light emitting unit 10 has twelve light output ports A/B/C/D/E/F/G/H/I/J/K/L, and sequentially emits the light from the twelve light output ports A—L. On the other hand, the light detecting unit 19 has eight light input ports 17*a*, and concurrently converts the light incident at the eight light input ports 17*a* to electric signals. The optical fibers 2 are separated into the twelve minor bundles FB(2), and the twelve minor bundles FB(2) of optical fibers 2 are branched from the major bundle AFB of optical fibers 2/3 at intervals. The twelve minor bundles FB(2) are respectively assigned to the twelve light output ports A to L, and are respectively inserted into the light output ports A to L. The twelve bundles FB(2) are adhered to the inner surfaces, which define the light output ports A to L, respectively.

The eight light input ports 17*a* are assigned to the eight minor bundles FB(3) of the optical fibers 3, respectively. The major bundle AFB is branched into the eight minor bundles FB(3) at intervals, and the diverging points are on the right side of the associated light input ports 17*a*. The bundles FB(3) are warped for directing the light output end portions to the light input ports 17*a*, and the light output end portions are respectively inserted into the light input ports 17*a* of the light detecting unit 19. The light output end portions are adhered to the inner surfaces of the light detecting unit 19 by means of the adhesive compound.

The major bundle AFB laterally extends on the rear section 43 at the back of the array of the light radiating sensor heads/light receiving sensor heads 20/30, and the optical fibers 2 and optical fiber 3 are alternately branched from the major bundle AFB at intervals. The diverging points are on the right side of the associated light radiating sensor heads/light receiving sensor heads 20/30, and the optical fibers 2/3 have respective end portions 2*a*/3*a* between the diverging points and the light input/output end surfaces. The light radiating sensor heads 2 and light receiving sensor heads 3 are formed with rear holes, and the optical fibers 2/3 are individually inserted into the rear holes. The optical fibers 2/3 are adhered to the associated light radiating sensor heads/light receiving sensor heads 20/30 by means of the adhesive compound.

Turning to FIG. 2, the light radiating sensor heads 20 and light receiving sensor heads 30 are illustrated at a large magnification ratio. The light radiating sensor heads and light receiving sensor heads 20/30 are made of transparent material such as, for example, acrylic resin, and are identical in contour with one another. The transparent material may be shaped into the light radiating sensor heads/light receiving sensor heads 20/30 through a molding process.

Each of the light radiating sensor heads 20 is imaginarily broken down into a head 20*a* and a body 20*b*, and has a line of symmetry 20*c*. The optical fiber 2 is secured to the body 20*b*, and radiates the light to the head 20*a*. The head 20*a* splits the light into two light beams, and sideward outputs the light beams toward the light receiving sensor heads 30 on both sides thereof.

The body 20*b* is formed with a hole 22*a*, and the hole 22*a* is open to a pit 22*b*. The hole 22*a* has a centerline, which is coincident with the line of symmetry 20*c*. The optical fiber 2 passes through the hole 22*a* and pit 22*b*, and is tightly held in contact with an end surface 22*c*, which defines a part of the pit 22*b*. For this reason, the light is radiated from the optical fiber 2 toward the head 20*a* along the line of symmetry 20*c*. The optical fiber 2 is fixed to the body 20*b* so as to keep the face-to-face contact with the end surface 20*c*. Though not shown in FIG. 2, an injection hole is further formed in the body 20*b*, and is open to the hole 22*a*. Adhesive compound is injected into the injection hole so that the optical fiber 2 is adhered to the inner surface.

The head 20*a* includes a pair of convex lenses 21L/21R and a pair of prisms 23*b*/23*c*. The prisms 23*b*/23*c* have respective reflecting surfaces 23*a*, and the reflecting surfaces 23*a* crosses each other at 90 degrees on the line of symmetry 20*c*. In other words, the reflecting surfaces 23*a* are inclined to the line of symmetry 20*c* at 45 degrees. The reflecting surfaces 23*a* form a V-shaped space 23. The convex lenses 21L/21R sideward project from the prisms 23*b*/23*c*, and are opposed to the adjacent light receiving optical sensor heads 30. The optical axes of the convex lenses 21L/21R cross the crossing line between the reflecting surfaces 23*a*.

The light is propagated from one of the light output port A, B, . . . or L through the optical fibers 2 to the light radiating sensor head 20, and is incident onto the end surface 22*c*. The output light proceeds to the reflecting surface 23*a* along the line of symmetry 20*c*. The output light is reflected on the reflecting surfaces 20*a*, and is split into two light beams. The light beams sideward proceeds, and are formed into parallel light beams by means of the convex lenses 21L/21R. Thus, the parallel light beams are output from the light radiating sensor head 20 toward the adjacent light receiving sensor heads 30.

The light receiving sensor head 30 is also broken down into a head 30*a* and a body 30*b*, and has a line of symmetry 30*c*. The head 30*a* and body 30*b* are identical with the head 20*a* and body 20*b*. For this reason, a hole, a pit, an end surface, reflecting surfaces, prisms, convex lenses and a V-shaped space, which are respectively corresponding to the hole 22*a*, pit 22*b*, end surface 22*c*, reflecting surfaces 23*a*, prisms 23*b*/23*c*, convex lenses 21L/21R and a V-shaped space 23, are labeled with references 32*a*, 32*b*, 32*c*, 33*a*, 33*b*/33*c*, 31L/31R and 33 without detailed description for the sake of simplicity.

The parallel light beams are incident on the convex lenses 31R/31L of the adjacent light receiving sensor heads 30, and are reflected on the reflecting surfaces 33*a*. The light beams are incident on the light input end surfaces of the optical fibers 3. The input light is propagated through the optical fibers, and reaches the different light input ports 17*a* of the light detecting unit 19.

The light emitting unit 10 includes an optical fiber plug 11, a light emitting diode socket 12 and light emitting elements 13. The light output ports A to L are formed in the optical fiber plug 11, and the light emitting elements 13, which may be implemented by light emitting diodes, are held inside the light emitting diode socket 12. The optical fiber plug 11 is assembled with the light emitting diode socket 12 so that the light emitting elements 13 are respectively opposed to the light output ports A to L. The optical fibers 2 are bundled to the twelve minor bundles FB(2), and the twelve minor bundles FB(2) are terminated at the light output ports A to L. Though not shown in the drawings, a driver circuit sequentially energizes the light emitting elements 13 with an electric driving pulse signal, and light pulses are emitted from the light emitting elements 13 to the light output ports A to L. The driving circuit repeatedly scans the light emitting elements 13 with the driving pulse signal so that the light pulses are distributed to the light radiating sensor heads 20 through the minor bundles FB(2) of the optical fibers 2.

The light detecting unit 19 also includes an optical fiber plug 17, a light detecting diode socket 18 and light detecting elements 19*a*. The light input ports 17*a* are formed in the optical fiber plug 17, and the light detecting elements 13, which may be implemented by light detecting diodes or light detecting transistors, are held inside the light detecting diode socket 18. The optical fiber plug 17 is assembled with the light detecting diode socket 18 so that the light detecting elements 19*a* are respectively opposed to the light input ports 17*a*. The minor bundles FB(3) are terminated at the light input ports 17*a*, and the incident light is converted to photo current. The optical fibers 3 are selectively assigned to the light input ports 17*a* in such a manner that the light is not concurrently output from more than one optical fiber 3 in each light input port 17*a*. The light is converted to the photo current through the light detecting elements 19*a*, and the photo-current is output from the light detecting unit 19 to the data processing module as hammer position signals.

The data processing module may drive the light emitting unit 10 to emit the light as disclosed in Japanese Patent Application laid-open No. Hei 9-152871. Twelve time slots are respectively assigned to the twelve light emitting elements 13, and are repeated until the electric power is removed from the data processing module. The twelve light emitting elements 13 are respectively energized in the time slots assigned thereto, and the light is propagated through the optical fibers 2 to the light radiating sensor heads 20. The light beams are radiated to the adjacent light receiving sensor heads 30, and the incident light is propagated through the optical fibers 3 to the light detecting elements 19*a*, respectively. As described hereinbefore, the incident light reaches each of the light detecting elements 19*a* through one of the optical fiber 3 of the associated minor bundle FB(3) in the time slot, and through another optical fiber 3 of the associated minor bundle FB(3) in the next time slot. Thus, the incident light is input to each light detecting element 19*a* from the different optical fibers 3 of the associated minor bundle FB(3) in the time slots. For this reason, the data processing module can specify the hammers 50 on the basis of the combinations between the time slots and the light input ports 17*a*.

Turning back to FIG. 1, the moving objects, i.e., the optical modulators 1 are rotated about the rotational axes of the associated hammers 50, and penetrate through the slots 51 into the space where the light radiating sensor heads/light receiving sensor heads 20/30 are installed. Each of the optical modulators 1 crosses associated one of the parallel light beams. As will be hereinafter described in detail, a photo-modulating pattern 1*e* or a gray scale (see FIG. 5) is printed on the optical modulators 1, and the photo-shield material per unit area is varied on the optical modulators 1. For this reason, the amount of light incident on the convex lens 31L or 31R is varied together with the current position of the optical modulator 1.

Figure 3:
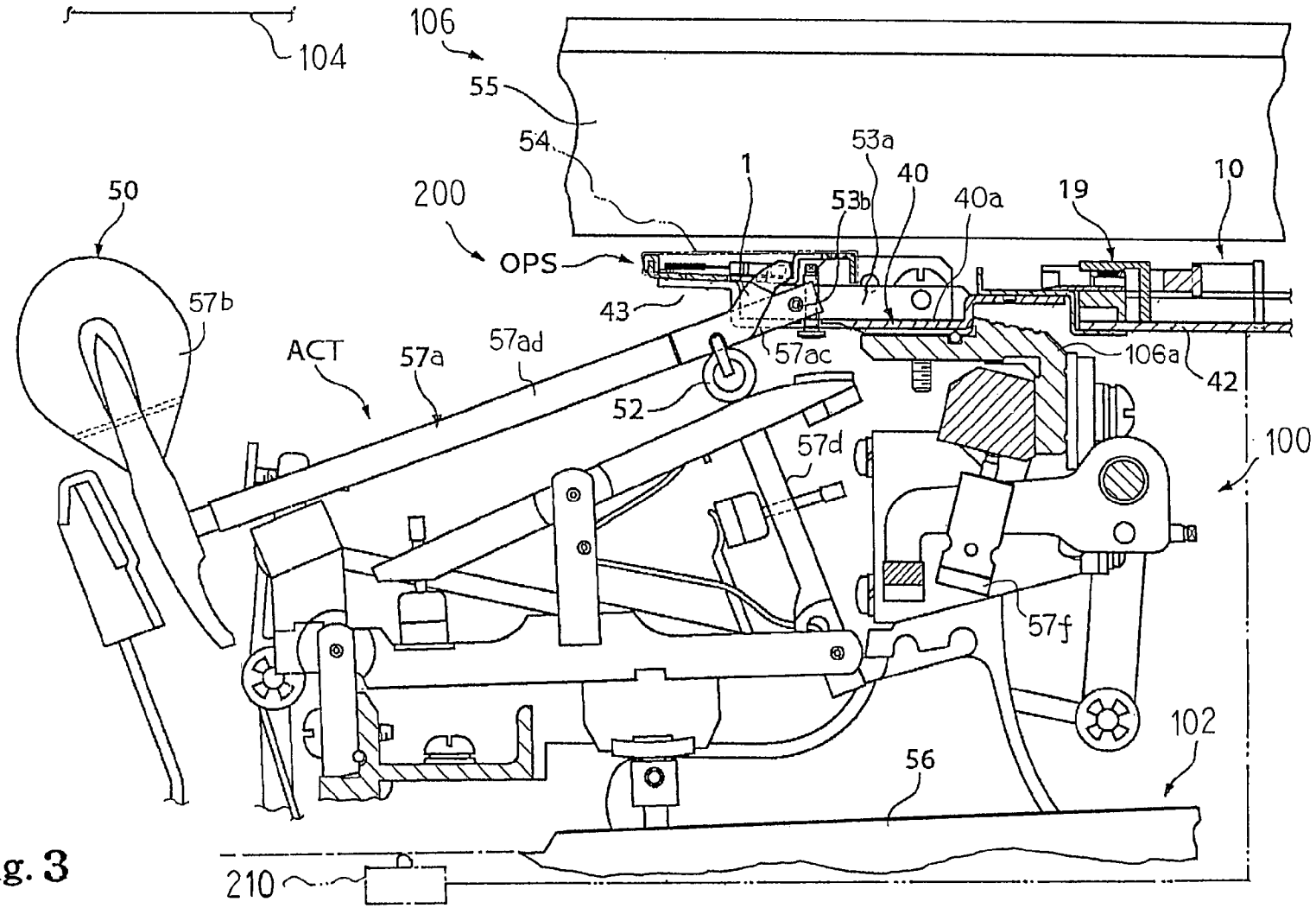
FIG. 3 is a side view showing the structure of an action unit of an automatic player piano.

Turning to FIG. 3 of the drawings, the automatic player piano largely comprises an acoustic piano 100 and an electronic system 200. The electronic system 200 is installed inside the acoustic piano 100, and a performance on the acoustic piano 100 is recorded and reproduced through the electronic system 200. The data processing module and optical transducer, i.e., the optical modulators 1 and photo-electric converter OPS are integral components of the electronic system 200. Pieces of position data, which are represented by the hammer position signals, are periodically fetched by the data processing module, and the data processing module analyzes the pieces of data for the hammer motion.

The acoustic piano is same as a standard grand piano, and includes a keyboard 102, action units ACT, hammers 50, strings 104 and a piano cabinet 106. The action units ACT are similar in structure to each other. The keyboard is mounted on a key bed, which forms a part of the piano cabinet 106, and is exposed to a pianist for fingering. The action units ACT, hammers 50 and strings 104 are housed in the piano cabinet 106. The keyboard 102 includes white keys and black keys, which are laid on the well known pattern, and one of the black/white keys is labeled with reference numeral 56. The black/white keys are respectively linked with the action units ACT, and the hammers 50 are driven for rotation through escape from the action units ACT. The strings 104 are stretched over the hammers 50, and are anchored at a pin block 55. The hammers 50 are brought into collision with the strings at the end of the rotation, and give rise to vibrations of the strings 104. Acoustic tones are radiated from the vibrating strings 104.

A hammer roller 52, a hammer shank flange 53*a*, a center pin 53*b*, a hammer shank 57*a* and a hammer head 57*b* are assembled into the hammer 50. The hammer shown in FIG. 1 is resting at a rest position. The hammer shank flange 53*a* is bolted to a shank flange rail 106*a*, and the hammer shank 57*a* is rotatably connected to the hammer shank flange 53*a* by means of the center pin 53*b*. The hammer head 57*b* is fixed to the leading end of the hammer shank 57*a*, and upwardly projects from the hammer shank 57*a*. The strings 104 are struck with the hammer heads 57*b*. Thus, the hammer shank 57*a* and hammer head 57*b* are rotatable about the hammer shank flange 53*a*, and the center pin 53*b* offers the rotational axis to the hammer shank 57*a* and hammer head 57*b*. The hammer shank 57*a* is formed with a dent 57*ab* (see FIG. 4), and has an inner portion 57*ac* is slightly thicker than an outer portion 57*ad*. The hammer roller 52 is hung from the inner portion 57*ac* of the hammer shank 57*a*, and is rotatable below the dent 57*ab*. While the hammer 50 is resting at the rest position, the hammer roller 52 is put on the upper surface of a jack 57*d*, which forms a part of the action unit ACT, and the hammer shank 57*a* is inclined to the key 56 as shown in FIG. 1.

When the black/white key 56 is depressed, the action unit ACT starts to rotate in the counter clockwise direction, and pushes the hammer roller 52. The jack 57*d* is brought into contact with a regulating button 57*f*, then, the jack 57*d* escapes from the hammer roller 52 so as to drive the hammer 50 for the free rotation. The hammer 50 rotates over 20 degrees from the rest position in the clockwise direction, and reaches an end position. The string 104 is struck with the hammer head 57*b* at the end position, and the hammer head 57*b* rebounds on the string 104. The centerline of the hammer shank 57*a* is labeled with L3 at the rest position and L4 at the end position, and lines vertical to the centerline L3/L4 is labeled with L1/L2. The angle between the rest position and the end portion is labeled with "θ1" in FIG. 4.

The electronic system includes the optical modulator 1, data processing module (not shown), another optical modulator (not shown) and an array of solenoid-operated key actuators 210. The optical modulator 1 and another optical modulator (not shown) are connected to the data processing module, and supply the hammer position signals and key position signals to the data processing module. The data processing module analyzes the hammer position signals and key position signals during an original performance on the keyboard 102, and produces a set of music data codes representative of the original performance. The data processing module is further operative to reproduce the performance. The data processing module sequentially processes the music data codes, and determines tones to be reproduced and times at which the tones are produced. When the time comes, the data processing module supplies a driving signal to the solenoid-operated key actuator 210 associated with the black/white key to be moved. Then, the solenoid-operated key actuator 210 gives rise the key motion without any fingering of a human player, and makes the hammer driven for rotation. The string 104 is struck with the hammer 50 so that the tone is produced through the vibrations of the string 104.

The optical modulator 1 is attached to the hammer shank 57*a*, and is curved toward the hammer shank 57*a*. Namely, the optical modulator 1 has a dogleg shape. On the other hand, the base frame 40 is bolted to the shank flange rail 106*a*, and keeps the light radiating sensor heads 20 and light receiving sensor heads 30 in the space between the center pins 53*b* and the pin block 55. The base frame 40 is adjusted to a proper position where the slots 51 are aligned with the trajectories of the optical modulators 1. While the hammer 50 is staying at the rest position, the optical modulators 1 are inserted into the space between the rear section 43 and the cover plate 54 through the slots 51, and project across the optical paths between the associated light radiating sensor heads 20 and the adjacent light receiving sensor heads 30. When the hammer 50 starts the rotation, the optical modulator 1 is also rotated in the counter clockwise direction about the center pin 53*b*, and the spot at which the light beam is intersected is moved on the optical modulator 1. The spot is moved in the photo-modulating pattern 1*e* or gray scale so that the amount of the incident light is modulated.

Figure 4:
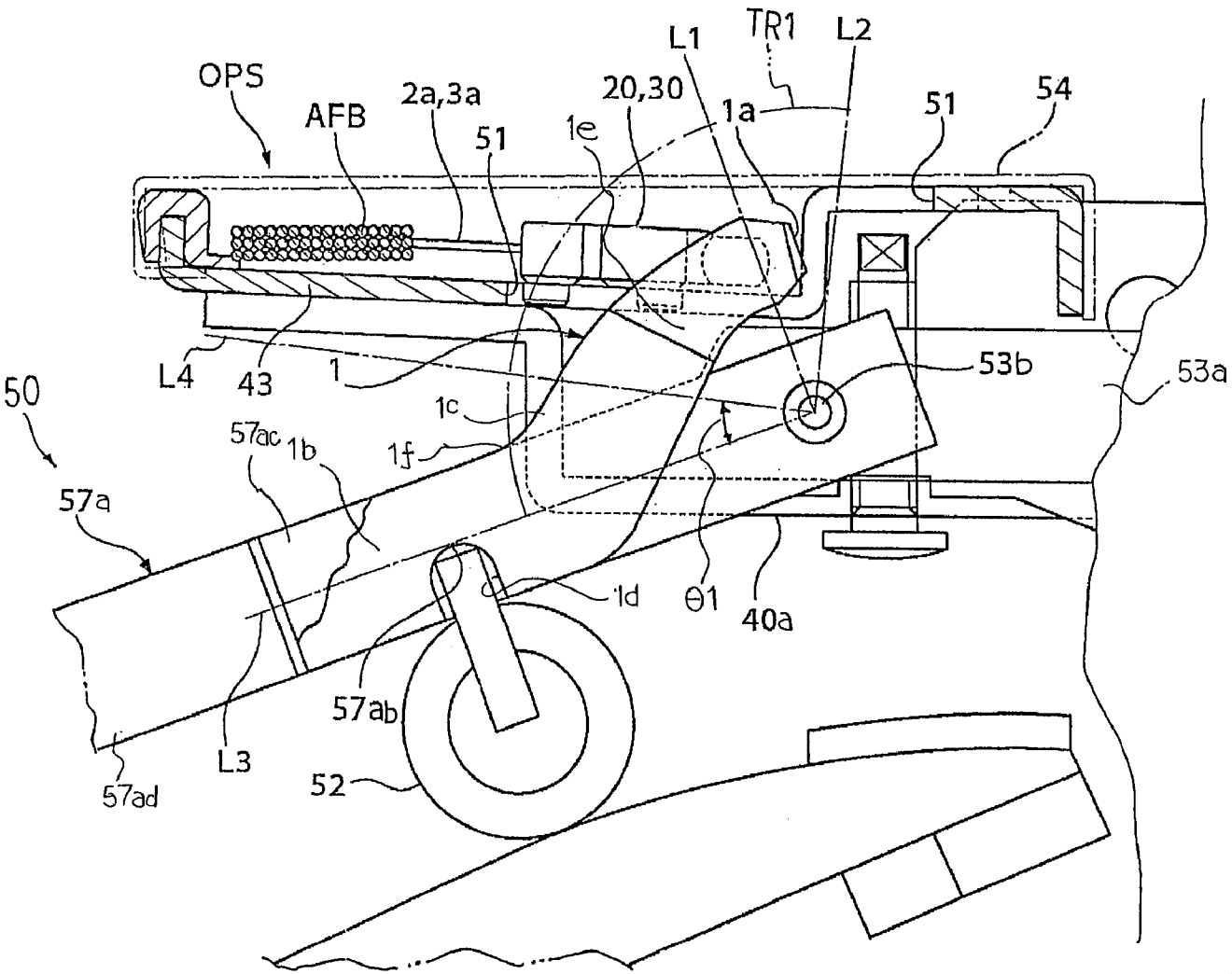
FIG. 4 is a side view showing an optical modulator and sensor heads provided on a base frame.
Figure 5:
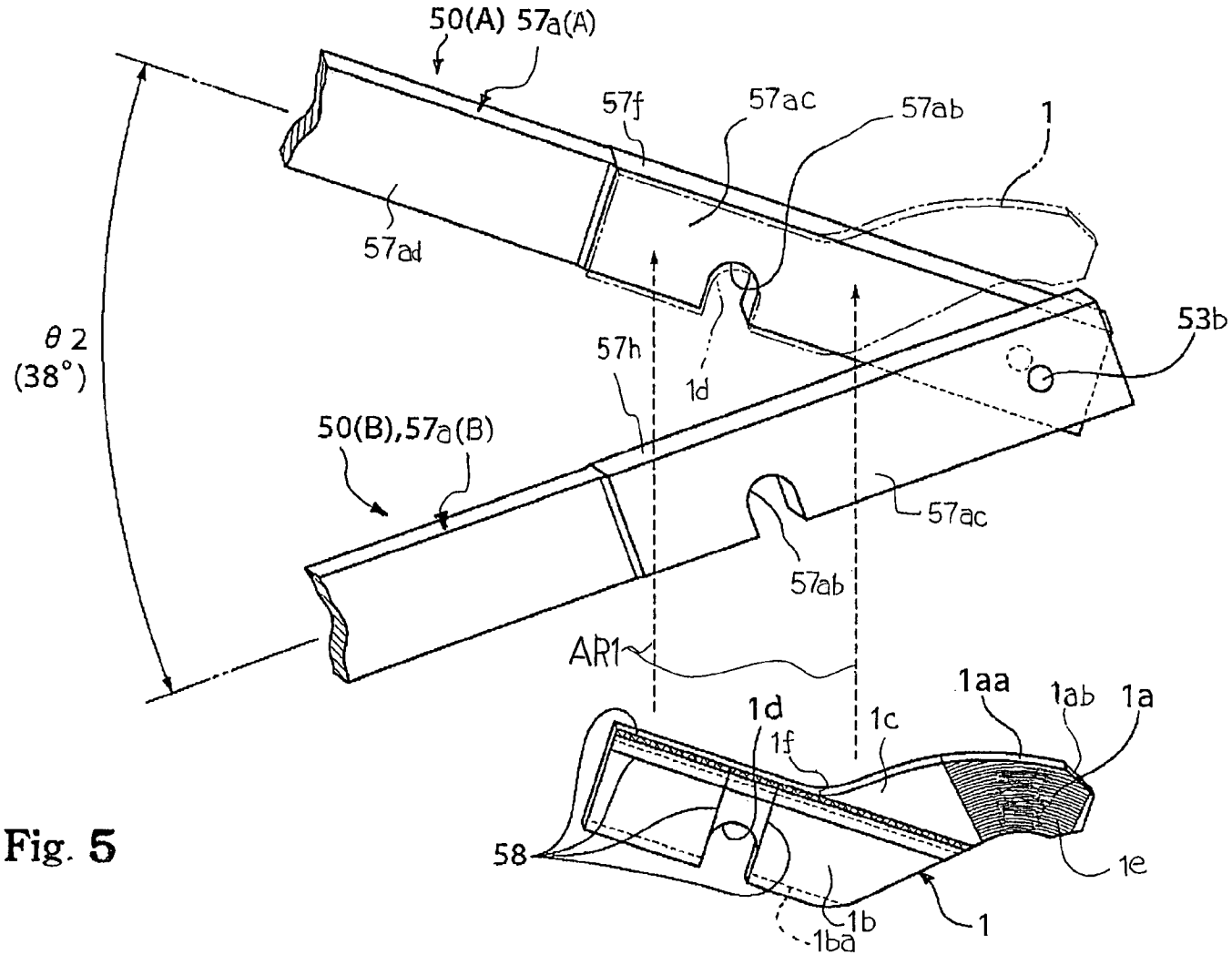
FIG. 5 is a perspective view showing a hammer shank and the optical modulator to be attached to the hammer shank.

Turning to FIGS. 4 and 5 of the drawings, the optical modulator 1 has a head portion 1*a*, a boss portion 1*b* and a neck portion 1*c*. A part of the boss portion 1*b* is cut out from the optical modulator 1 shown in FIG. 4. The boss portion 1*b* is as wide as the hammer shank 57*a*, and a dent 1*d* is formed in the boss portion 1*b*. The dent 1*d* has the outline identical with that of the dent 57*ab*, and the dents 1*d*/57*ab* serve as an alignment mark in an assembling work. Marking lines 58 are further formed in the boss portion 1*b*, and are further available for the alignment between the optical modulator 1 and the inner portion 57*ac* of the hammer shank 57*a*. Adhesive compound is spread over a side surface 1*ba* of the boss portion, and the boss portion 1*b* is pressed to the inner portion 57*ac*. Then, the optical modulator 1 is adhered to the side surface of the inner portion 57*ac* by means of the adhesive compound.

The optical modulator 1 raises the neck portion 1*c* over the upper surface 57*h* of the hammer shank 57*a*. Reference numeral 1*f* designates a boundary between the boss portion 1*b* and the neck portion 1*c*, and the boundary 1*f* is coplanar with the upper surface 57*h* of the inner portion 57*ac*. Dots-and-dash line TR1 is indicative of the trajectory of the boundary 1*f*. The neck portion 1*c* is curved toward the upper surface 57*h* so that the photo-modulating pattern 1*e* is closer to the center pin 53 than the trajectory 1*f*. A curved surface 1*aa* extends from the neck portion 1*c* toward the head portion 1*a*, and has a center on the rotational axis of the hammer 50. The upper surface 1*aa* is inclined to the center pin 53*b* as indicated by lab. The inclined portion lab prevents the head portion 1*a* from interference with the cover plate 54.

At least the head portion 1*a* is made of transparent material, and the photo-modulating pattern 1*e* or gray scale is printed on the side surface or surfaces of the head portion 1*a*. Plural non-transparent arcs form in combination the photo-modulating pattern 1*e*, and have a common center on the rotational axis of the hammer 50. The ratio of non-transparent area to the transparent area is increased toward the tip of the head portion 1*a*, and, accordingly, the amount of light passing through the head portion 1*a* is decreased toward the tip.

Figure 6:
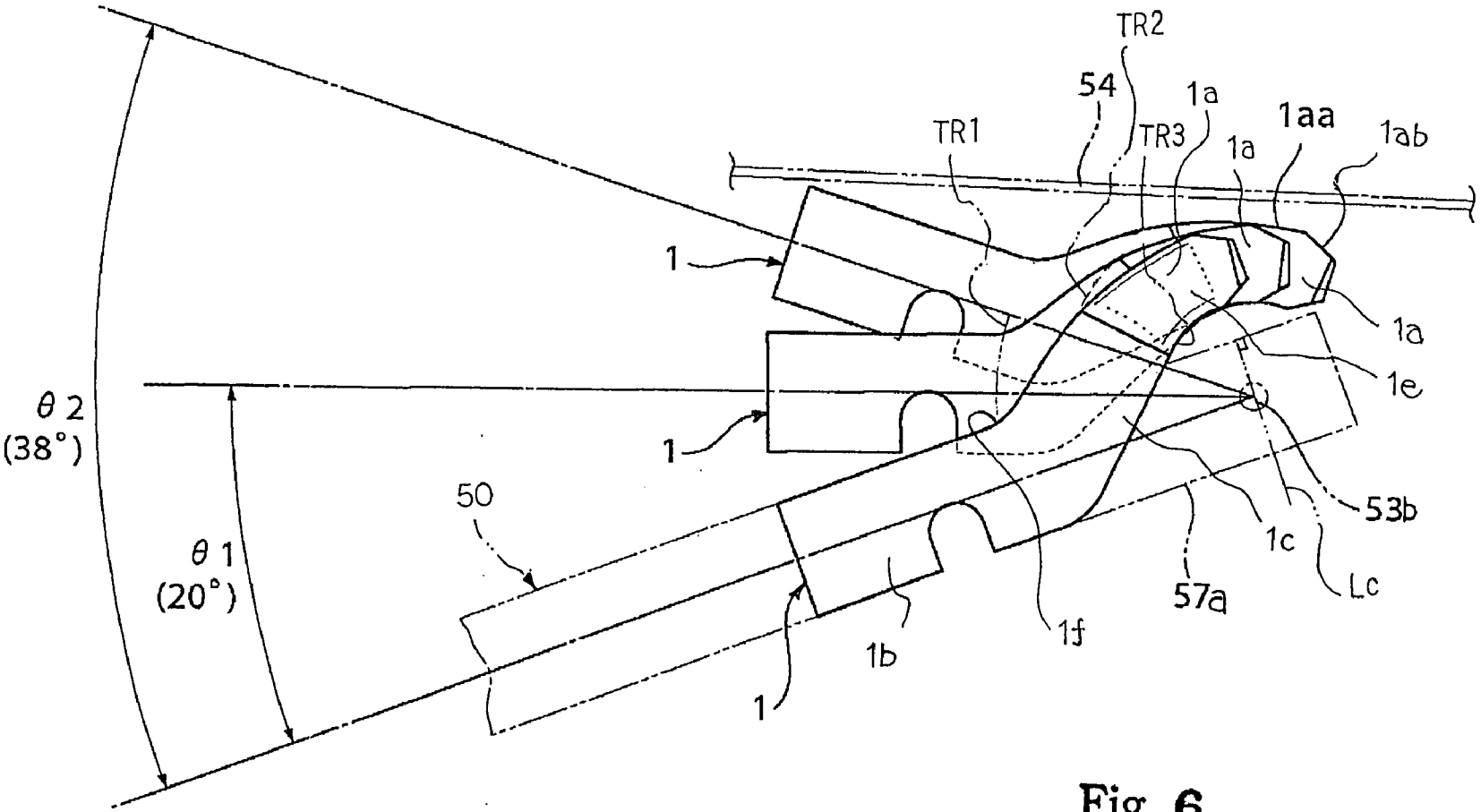
FIG. 6 is a side view showing the positions of the optical modulator at different positions of a hammer.

The optical modulators 1 are attached to the hammers 50 in the retrofitting work as follows. Reference numeral 50(A) designates one of the hammers 50 at an assembling position, which is spaced from the adjacent hammer 50(B) at the rest position by a certain angle θ2, and the hammer shanks at the assembling position and the rest position are labeled with 57*a*(A) and 57*a*(B), respectively. The hammer shanks 57*a* are spaced from one another by a distance not less than the thickness of the boss portions 1*b*. The cover plate 54 is spaced from the rear section 43 in such a manner as to permit the optical modulators 1 to rotate over 38 degrees at the maximum as shown in FIG. 6. For this reason, the certain angle θ2 is 38 degrees in this instance. The photo-electric converter OPS has not been bolted to the shank flange rail 106*a*, yet. In case where the workers are assembling the component parts into the automatic player piano in the manufacturer's factory, the hammer heads 57*b* may be fixed to the leading ends of the hammer shanks 57*a* after the assemblage between the hammer shanks 57*a* and the optical modulators 1.

Turning back to FIG. 5, the worker firstly rotates the hammer shank 57*a*(A) over the certain angle θ2, and keeps the hammer shank 57*a*(A) thereat. Then, the side surface around the dent 57*ab* is well spaced from the center pin 53*b* so as to be exposed to the worker. The adhesive compound has been already spread over the side surface 1*ba* of the boss portion 1*b*.

Subsequently, the worker takes the optical modulator 1, and moves the optical modulator 1 toward the exposed side surface of the inner portion 57*ac* of the hammer shank 57*a*(A). The worker makes the dent 1*d* aligned with the dent 57*ab* and the upper surface of the boss portion 1*b* coplanar with the upper surface 57*h* of the inner portion 57*ac*. The worker may rely on the marking lines 58 for the alignment. When the worker gets ready to adhere the optical modulator 1 to the hammer shank 57*ac*, the worker presses the optical modulator 1 to the inner portion 57*ac* of the hammer shank 57*a*(A) as indicated by arrow AR1.

The worker repeats the above-described steps for the other hammers 50 so that the optical modulators 1 are attached to the hammer shanks 57*a* without disassembly of the hammers 50 from the shank flange rail 106*a*. Finally, the worker takes the photo-electric converter OPS, and moves it over the shank flange rail 106*a*. The worker aligns the slots 51 with the optical modulators 1, and secures the base frame 40 to the shank flange rail 106*a* by means of the bolts.

Thus, the assemblage between the optical modulators 1 and the hammer shanks 57*a* is much simpler than the assembling work on the second prior art optical transducer. The optical modulators 1 are further advantageous over the photo-filter or optical modulator of the second prior art optical transducer in that they are surely secured to the hammer shanks 57*a*. This is because of the fact that the boss portions 1*b* are extensible toward the hammer heads 57*b*. In other words, it is possible to increase the area adhered to the side surface of the hammer shanks 57*a*.

The dent 1*d* is desirable for the assembling work, because the worker easily disposes the optical modulators 1 at the proper positions on the side surfaces of the hammer shanks 57*a*. The marking lines 58 are also helpful to the worker in the aligning work. This results in the reliable hammer position signals.

While the hammer 50 is rotating from the rest position to the end position, the boundary 1*f* traces the trajectory TR1, and the photo-modulating pattern 1*e* or gray scale is moved in the space indicated by fictitious lines TR2 and TR3. (See FIG. 6) If the head portion 1*a* were vertical to the upper surface of the hammer shank 57*a*, the photo-modulating pattern 1*e* or gray scale would be moved outside of the trajectory TR1, and the optical modulator 1 would require a wide space for the photo-modulating pattern 1*e*. However, the neck portion 1*c* makes the head portion 1*a* and, accordingly, the photo-modulating pattern 1*e* closer to the center pin 53*b* than the boss portion 1*b*. For this reason, the space required for the photo-modulating pattern 1*e* is narrower than those for the prior art optical modulators. The closer the photo-modulating pattern, the narrower the space. However, it is necessary to prevent the photo-modulating pattern 1*e* from overlap with the hammer shank 57*a*. From these points of view, the neck portion 1*c* may keep the head portion 1*a* just on the area of the upper surface of the hammer shank 57*a* where the foot of a perpendicular line Lc is.

Thus, the space required for the photo-modulating pattern 1*e* is narrower than the space required for the shutter plate of the first prior art optical transducer is. It is possible to form the photo-modulating pattern as wide as the trajectory of the hammer 50 between the rest position and the end position on the head portion 1*a* without any interference with other component parts.

As will be understood from the foregoing description, the optical modulator 1 according to the present invention has the photo-modulating pattern 1*e* closer to the rotational axis of the hammer 50 than the boss portion 1*b* which is secured to the hammer shank. A narrow space is required for the photo-modulating pattern so that it is possible to monitor the moving object, i.e., the hammer over the entire trajectory without any interference with other component parts. Moreover, the area where to boss portion 1*b* is to be secured is surely exposed to the worker so that the worker easily secures the boss portion 1*b* to the area.

Second Embodiment

Figure 7:
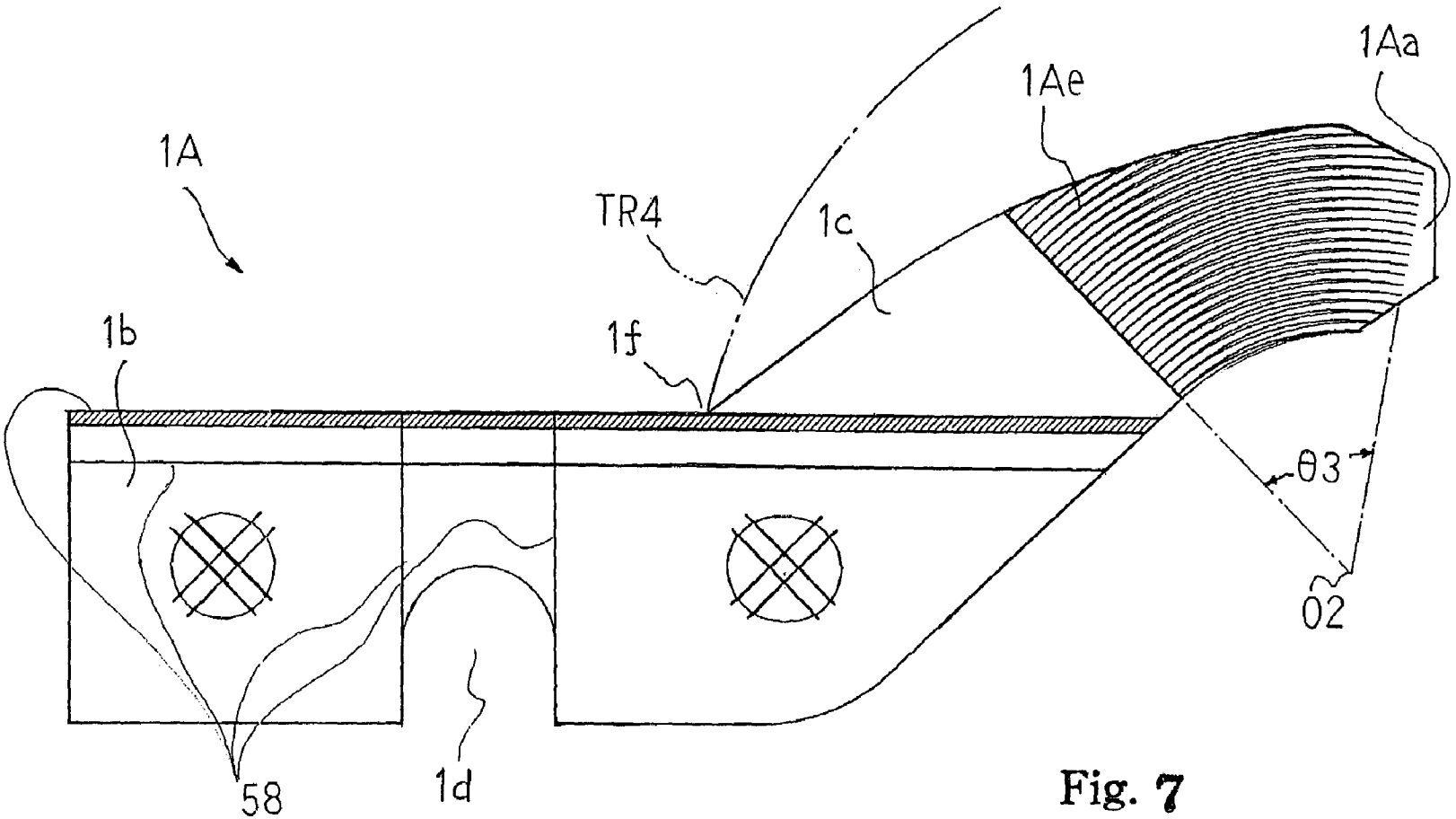
FIG. 7 is a side view showing a photo-modulating pattern on an optical modulator incorporated in another optical transducer according to the present invention.

Turning to FIG. 7 of the drawings, another optical transducer according to the present invention also largely comprises an optical modulator 1A and a photo-electric converter (not shown). The optical transducer implementing the second embodiment is installed in a mute piano, and serves as hammer sensors. The mute piano is fabricated on the basis of an acoustic piano, and the optical transducer forms a part of an electronic tone generating system. A hammer stopper is further installed in the acoustic piano, and is changed between a free position and a blocking position. While the hammer stopper is staying at the free position, the strings are struck with the hammers at the end of the free rotation. When the hammer stopper is changed to the blocking position, the hammer stopper enters the trajectories of the hammers, and makes the hammers to rebound thereon before reaching the strings. For this reason, any acoustic piano tone is not generated from the strings.

The black and white keys are monitored with another optical transducer, and key position signals are supplied from the other optical transducer to a controller. The other optical transducer, controller and an audio system form the other parts of the electronic tone generating system. The controller analyzes the key position signals and hammer position signals for the key motion and hammer motion, and produces music data codes representative of electronic tones to be produced. An audio signal is produced on the basis of the music data codes, and is supplied to the audio system for producing the electronic tones. In case where the audio signal is converted to the electronic tones through a headphone, the user can practice the fingering on the keyboard without disturbance to the neighborhood.

The photo-electric converter (not shown) is similar in structure to the photo-electric converter OPS, and no further description is hereinafter incorporated for the sake of simplicity. Description is focused on the optical modulator 1A.

The optical modulator 1A is made of PET (Poly-Ethylene Terephthalate), and is also imaginarily broken down into a boss portion 1*b*, a neck portion 1*c* and a head portion 1Aa. Although an area, which is indicated by hatching lines, is colored in black, the boss portion 1*b* and neck portion 1*c* are analogous to those of the optical modulator 1, and marking lines and a dent are labeled with the references designating the marking lines and dent in FIG. 5.

A photo-modulating pattern 1Ae is printed on the head portion 1Aa, and is constituted by twenty-six lines drawn like a zigzag pattern. The zigzag pattern has a center O2, which is to be coincident with the rotational axis of the associated hammer after the assemblage with the hammer shank. The zigzag lines are spread over 54 degrees, i.e., θ3=54 degrees. The zigzag pattern is colored in black. The black area is maximized at the center, and is decreased toward both ends of the zigzag pattern.

The photo-modulating pattern 1Ae is closer to the rotational axis of the hammer than the trajectory TR4 of the boundary 1*f*. Thus, the optical transducer implementing the second embodiment achieves all the advantages of the first embodiment.

Although particular embodiments of the present invention have been shown and described, it will be apparent to those skilled in the art that various changes and modifications may be made without departing from the spirit and scope of the present invention.

Figure 8:
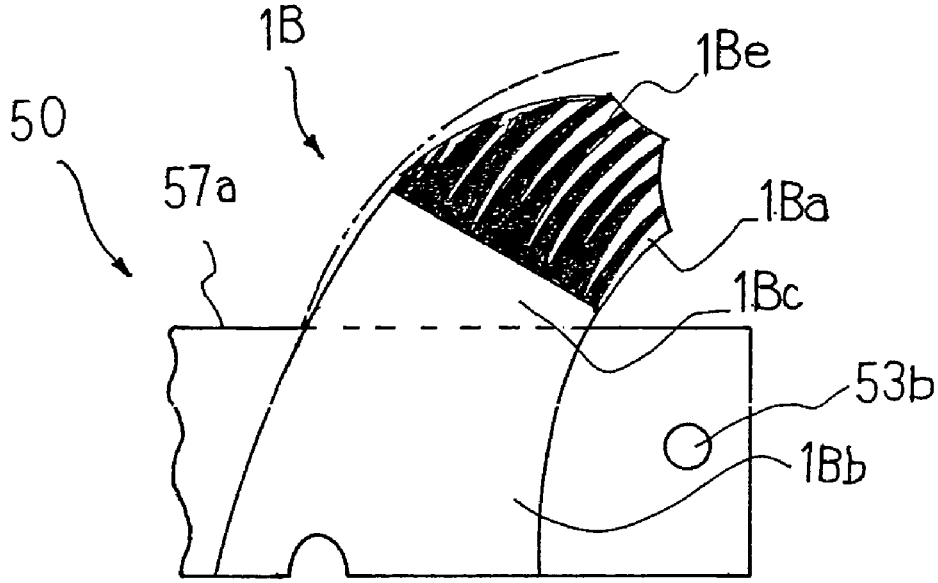
FIG. 8 is a side view showing yet an optical modulator incorporated in yet another optical modulator according to the present invention.
Figure 9:
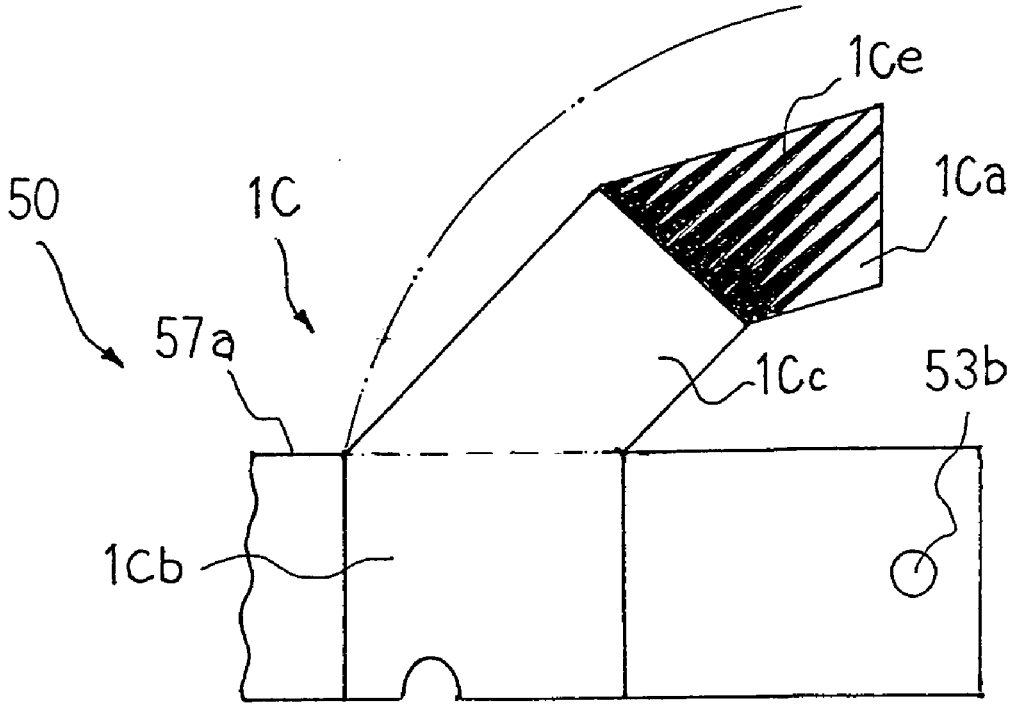
FIG. 9 is a side view showing yet an optical modulator incorporated in still another optical modulator according to the present invention.

FIGS. 8 and 9 show other optical modulators 1B and 1C according to the present invention. The optical modulator 1B has a contour like a fin, and is also imaginarily broken down into a head portion 1Ba assigned to a photo-modulating pattern 1Be, a boss portion 1Bb adhered to the side surface of the hammer shank 57*a* and a neck portion 1Bc between the head portion 1Ba and the boss portion 1Bb. The neck portion 1Bc makes the head portion 1Ba closer to the center pin 53*b* than the boss portion 1Bb. The optical modulator 1C is also imaginarily broken down into a head portion 1*ca*, a boss portion 1Cb and a neck portion 1Cc, and these portions 1Ca, 1Cb and 1Cc are defined by flat surfaces instead of the round surfaces. A photo-modulating pattern 1Ce is closer to the center pin 53*b* than the boss portion 1Cb.

Yet another optical modulator may have a head portion directly connected to a boss portion. In other words, the neck portions may be deleted from the optical modulators.

Still another optical modulator may be secured to the side surface at both end portions thereof. In this instance, the both end portions serve as a connecting portion.

The optical transducer according to the present invention may monitor the black/white keys, other parts of the action units or manipulators of another sort of musical instrument such as, for example, a training piano, a percussion instrument, a stringed musical instrument or a wind musical instrument.

The adhesive compound does not set any limit on the technical scope of the present invention. The optical modulators 1 may be secured to the hammer shanks by means of screws.

The ratio of the non-transparent area to the transparent area may be decreased to the tip of the head portion. The non-transparent pattern does not set any limit on the technical scope of the present invention. A semi-transparent pattern or a transparent pattern is available for the optical modulator in so far as the semi-transparent pattern or transparent pattern is different in light permissibility from the head portion. For example, a dot pattern, a slit pattern or a window may be formed in the head portion 1*a*. Otherwise, a light reflecting pattern may be formed in the head portion 1*a* under the condition that the light radiating sensor heads/light receiving sensor heads are replaced with an array of photo-reflectors.

The angles θ1 and θ2 may be greater than or less than 20 degrees and 38 degrees. The angle θ1 is depending upon the distance between the hammer head 57*b* and the associated string 104 and the length of the hammer shank 57*a*. The angle θ2 is varied together with the height of the cover plate 54 from the center pin 53*b*. Thus, the angles θ1 and θ2 do not set any limit to the technical scope of the present invention. The boss portion 1*b* may be attached to another area father from or closer to the center pin 53*b* than the area shown in FIG. 5, because the area where the boss portion is attached is dependent on the angle θ2.

The optical modulators 1 may be attached to the hammer shanks 57*a* with the assistance of a suitable machine or a jig.

The photo-electric converter OPS does not set any limit to the technical scope of the present invention. An array of photo-couplers or an array of photo-reflectors is available for the optical modulator according to the present invention.

The center pins may be replaced with a long shaft shared among the hammers 50.

The inclined portion 1*ab* is not formed in the head portion 1*a* under the condition that the cover plate is widely spaced from the base frame 40 or is deleted from the photo-electric converter OPS.

The optical transducer may convert the velocity of a moving object to an electric signal. In this instance, the optical modulator is, by way of example, formed with a window, and the photo-electric converter raises the potential level while the light beam is traveling the window. The duty ratio of the pulse is inversely proportional to the velocity of the moving object. Thus, the optical transducer can convert the velocity of the moving object to the electric signal.

In an application, the trajectory of the moving objects may be dividable into plural sections each having an instantaneous center. In other words, even though the center pin 53*b* is movable, the optical modulator according to the present invention is available for the optical transducer.

The component parts described hereinbefore are correlated with claim language as follows. The hammers 50 serve as "moving objects" and "predetermined component parts". The boss portions 1*b*/1Bb/1Cb are corresponding to connecting portions, and the head portions 1*a*/1Ba/1Ca printed with the photo-modulating patterns 1*e*/1Ae/1Be/1Ce serve as photo-modulating portions. The center pins 53*b* offer instantaneous centers to the moving objects. "Current status" represents the current hammer positions.

The space between said hammer shanks 57*a* at the rest positions and the strings 104 is corresponding to "vacant space". The upper surfaces 57*h* and lower surfaces of the hammer shanks 57*a* serve as "pairs of end surfaces".

The keyboard 102, action units ACT, hammers 50 and array of solenoid-operated key actuators 210 as a whole constitute "plural series of component parts" in the first embodiment. In the second embodiment, the keyboard, action units and hammers of the acoustic piano as a whole constitute "plural series of component parts". The strings 104 and the other optical transducer form other parts of "tone generating system" in the first embodiment. The strings, the other optical transducer and audio system form other parts of "tone generating system" in the second embodiment, and the controller serves as the data processing module.

The solenoid-operated key actuators 210 are corresponding to "key actuators". The shank flange rail 53*a* serves as "stationary member".

What is claimed is:

1. An optical transducer producing electric signals representative of current status of moving objects having respective surfaces overlapped with one another at rest positions and moved on respective trajectories each having an instantaneous center, comprising:

a photoelectric converter radiating light and converting incident light to said electric signals; and optical modulators including respective connecting portions secured to said surfaces of said moving objects, respectively, and photo-modulating portions closer to the instantaneous centers than said connecting portions and modulating said light for supplying said incident light representative of said current status to said photoelectric converter.

2. The optical transducer as set forth in claim 1, in which each of said trajectories is substantially in parallel to the surface of associated one of said moving objects.

3. The optical transducer as set forth in claim 2, in which said surfaces define side surfaces of said moving objects, and said moving objects further have other side surfaces and respective pairs of end surfaces through which said trajectories pass.

4. The optical transducer as set forth in claim 1, in which said optical modulators further include respective neck portions connected between said connecting portions and said photo-modulating portions respectively, and said neck portions project into vacant space in front of said moving objects at said rest positions so as to keep said photo-modulating portions in said vacant space.

5. The optical transducer as set forth in claim 4, in which said neck portions are curved from said connecting portions to said photo-modulating portions.

6. The optical transducer as set forth in claim 4, in which said neck portions and said photo-modulating portions have a dogleg shape.

7. The optical transducer as set forth in claim 1, in which said instantaneous centers are unchanged while said moving objects are traveling on said trajectories.

8. The optical transducer as set forth in claim 7, in which said trajectories have respective end positions spaced from said respective rest positions so that said moving objects are rotated between said respective rest positions and said respective end positions.

9. The optical transducer as set forth in claim 1, in which said photo-modulating portions have respective head portions and a pattern formed on said head portions different in light transmittance from said head portions.

10. The optical transducer as set forth in claim 9, in which the ratio of an area occupied by a part of said pattern to a unit area is varied.

11. The optical transducer as set forth in claim 9, in which plural arcs form in combination said pattern.

12. The optical transducer as set forth in claim 9, in which said pattern is formed of non-transparent material, and said head portion is formed of transparent material.

13. A musical instrument for producing tones, comprising:

plural series of component parts independently actuated for specifying tones to be produced; and a tone generating system associated with said plural series of component parts, producing said tones specified through said plural series of component parts, and including a data processing module analyzing music data for producing said tones and an optical transducer connected to said data processing module and monitoring predetermined component parts of said plural series having respective surfaces overlapped with one another at rest positions and moved on respective trajectories each having an instantaneous center for producing electric signals representative of predetermined pieces of said music data, said optical transducer including a photo-electric converter radiating light and converting incident light to said electric signals and optical modulators including respective connecting portions secured to said surfaces of said predetermined component parts, respectively, and photo-modulating portions closer to the instantaneous centers than said connecting portions and modulating said light for supplying said incident light representative of said current status to said photo-electric converter.

14. The musical instrument as set forth in claim 13, in which said musical instrument is fabricated on an acoustic piano.

15. The musical instrument as set forth in claim 14, in which keys, action units, hammers and key actuators form in combination said plural series of component parts, and strings form parts of said tone generating system.

16. The musical instrument as set forth in claim 15, in which said hammers serve as said predetermined component parts, and said hammers have respective hammer shanks, hammer heads secured to leading ends of said hammer shanks and shank flanges secured to a stationary member and permitting said hammer shanks to rotate about pins connected between said hammer shanks and said shank flanges.

17. The musical instrument as set forth in claim 16, in which a side surface of each of said hammer shanks serve as one of said surfaces to which said connecting portions are secured.

18. The musical instrument as set forth in claim 17, in which said optical modulators further include respective neck portions provided between said connecting portions and said photo-modulating portions and keeping said photo-modulating portions in vacant space between said hammers at said rest positions and said strings.

19. The musical instrument as set forth in claim 13, in which said photo-modulating portions have respective head portions and a pattern formed on said head portions and different in light transmittance from said head portions.

20. The musical instrument as set forth in claim 19, in which plural non-transparent arcs form in combination said pattern.

21. The musical instrument as set forth in claim 20, in which the ratio of an area occupied by a part of said transparent arcs to a unit area is varied.

* * * * *